US005209357A

United States Patent [19]

Cannon

[11] Patent Number: 5,209,357

[45] Date of Patent: May 11, 1993

[54] HANGING BOOK END DEVICE

[76] Inventor: Robert H. Cannon, 5449 Van Buren St., Merrillville, Ind. 46410

[21] Appl. No.: 832,951

[22] Filed: Feb. 10, 1992

[51] Int. Cl.[5] ..... A47B 65/00

[52] U.S. Cl. ..... 211/43; 211/162; 211/184; 16/95 R; 108/61

[58] Field of Search ..... 211/43, 42, 184, 94, 211/162; 248/246; 108/61; 16/95 R

[56] References Cited

U.S. PATENT DOCUMENTS

| | | | |
|---|---|---|---|
| 560,851 | 5/1896 | Hine | 211/43 |
| 575,832 | 1/1897 | Peate | 211/184 |
| 608,515 | 8/1898 | Frazee | 211/43 |
| 935,560 | 9/1909 | Stone | 211/184 |
| 1,898,533 | 2/1933 | Harriman | 211/43 X |
| 2,346,150 | 4/1944 | Brown | 211/184 X |
| 2,489,164 | 11/1949 | Shwayder | 211/94 X |
| 2,953,258 | 9/1960 | Streit | 211/184 |
| 3,120,894 | 2/1964 | Conley | 211/43 |
| 3,142,384 | 7/1964 | Fridokph | 211/43 |
| 3,146,888 | 9/1964 | Schaefer et al. | 211/43 |
| 3,202,298 | 8/1965 | Koreska | 211/43 X |
| 3,429,540 | 2/1969 | Worrallo | 248/246 |
| 3,465,896 | 9/1969 | Cafiero et al. | 108/61 |
| 3,489,292 | 1/1970 | Schnarr | 211/43 X |
| 4,421,289 | 12/1983 | Sturn | 248/246 |
| 4,584,950 | 4/1986 | Adams et al. | 211/43 X |
| 4,775,058 | 10/1988 | yatsko | 211/184 |

FOREIGN PATENT DOCUMENTS

| | | | |
|---|---|---|---|
| 28262 | 8/1909 | Sweden | 211/43 |
| 394537 | 10/1963 | Switzerland | 211/43 |
| 895152 | 5/1962 | United Kingdom | 211/43 |
| 2070924 | 9/1981 | United Kingdom | 211/42 |

*Primary Examiner*—Blair M. Johnson
*Assistant Examiner*—Korie H. Chan

[57] ABSTRACT

The hanging book end device includes a slotted track for installation above a book shelf, and a book end which is hung from the track. The top of the book end is flanged to fit into the track slots in a manner such that book end can be positioned anywhere along the track. The flange is made so as to prevent inadvertent shifting of the book end when books lean against it. A typical application of this book end device would be installation in a bookcase.

1 Claim, 3 Drawing Sheets

HANGING BOOK END DEVICE

BACKGROUND OF INVENTION

1. Field of Invention

This invention relates generally to a book end, and more particularly to a book end for use on a book shelf typically found in a bookcase.

2. Description of Prior Art

Various types of book ends are presently available in the marketplace. The type which is most commonly used is one which consists essentially of a heavy weight which has a flat base and one flat vertical surface to contact books placed on the shelf. This type usually has some sort of aesthetic design for sake of appearance, but is not fully effective because it lacks the stability to resist the full force of leaning books.

A variation of this type incorporates an inverted T-shaped design wherein the flange or horizontal part serves as the base of the book end. Part of this base must be pushed beneath the books for stability. This type is effective but is cumbersome to use because it requires some of the books in order to slide the base beneath them.

Another type of book end also incorporates an inverted T-shaped design, except that the base is made to fit into a recessed slot built into a book shelf during fabrication. Although this type is very effective, it requires the use of a specially constructed steel bookcase. This type is used primarily in libraries where functionality is of greater importance than aesthetics.

Presently available book ends have various disadvantages such as being less than fully effective, being cumbersome to use and consuming valuable shelf space.

SUMMARY OF THE INVENTION

The general object of my invention is to provide an improved and simply constructed pendant type book end which is functional and easy-to-use, and which can be used in any ordinary bookcase not requiring special recesses or built-in slots.

Another object of my invention is to provide a book end which will not use up valuable shelf space.

Still another object of my invention is to provide a book end the use of which will obviate the need to re-position it each time one or two books removed from the shelf.

The book end constructed in accordance with my invention comprises a support track which must be located above a book shelf, and a book end suspended from the track. The combination of these two parts is hereinafter referred to as the book end device. This book end device is limited to applications where a horizontal surface on which to mount the track is available above the book shelf, such as in a typical bookcase.

To support books on any given shelf, the track is mounted on the bottom side of the horizontal surface which is immediately above the given shelf. The book end is hung from the track and positioned so as to engage the books below and support them in an upright position. The top of the book end is shaped so as to fit snugly into slots in the track to prevent inadvertent shifting of the book end, but also allow the book end to be manually positioned anywhere along the length of the track. Either side of the book end may be used to engage a book, a feature that most other types of book ends do not have. Multiple book ends may be hung from a single track, creating virtual partitions over the book shelf and enabling the arrangement of books in several groupings.

Other objects and advantages of the invention will hereinafter appear, and for purposes of illustration, but not of limitation, an embodiment of the invention is described in conjunction with the accompanying drawings.

Description of the Preferred Embodiment

Figure 1:
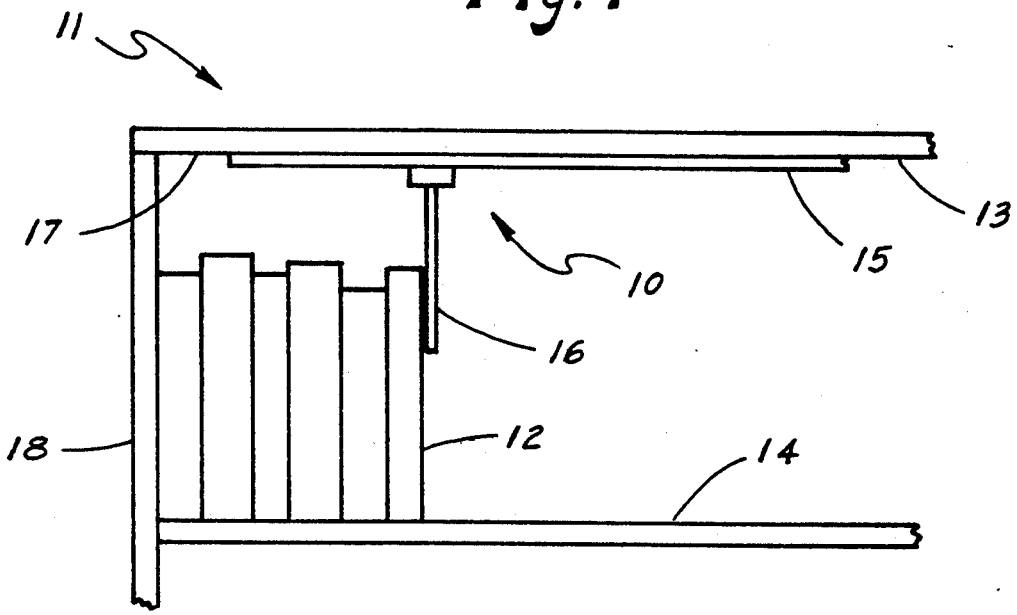
FIG. 1 is a front elevation view of a bookcase illustrating the use of my invention.

My hanging book end device has been generally indicated by the reference numeral 10 in FIG. 1, and is illustrated in conjunction with a bookcase 11 containing several books 12. Note that the book end device 10 is shown mounted on the bookcase surface 13 which is immediately above the shelf being served.

Figure 2:
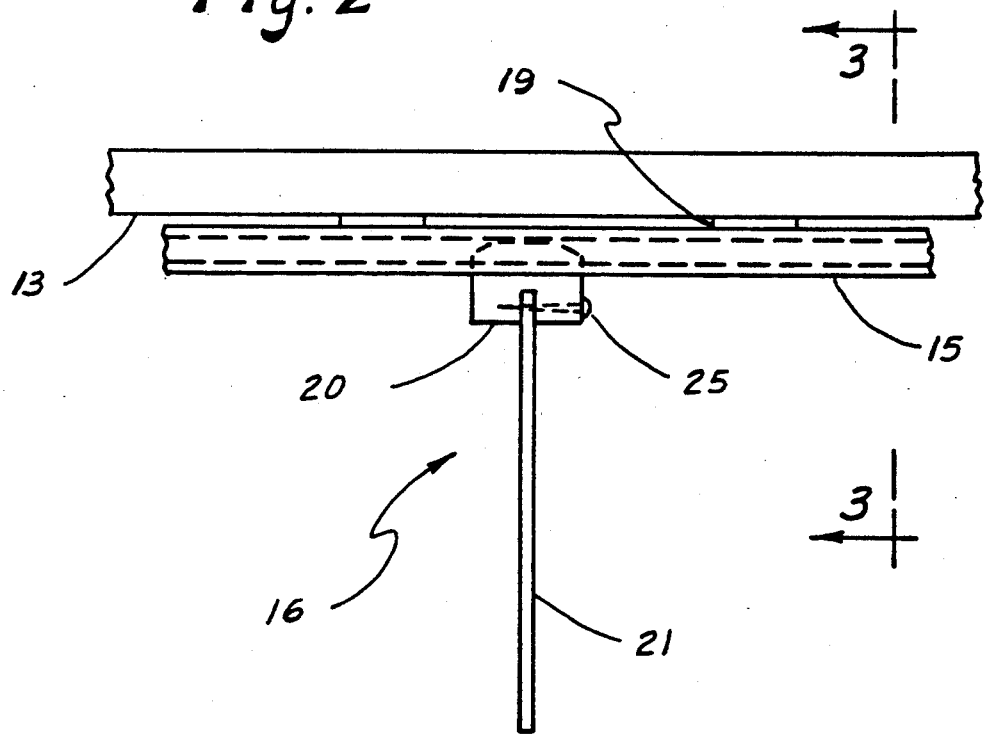
FIG. 2 is an enlarged elevation view of the book end device showing the track and one hanging book end.
Figure 3:
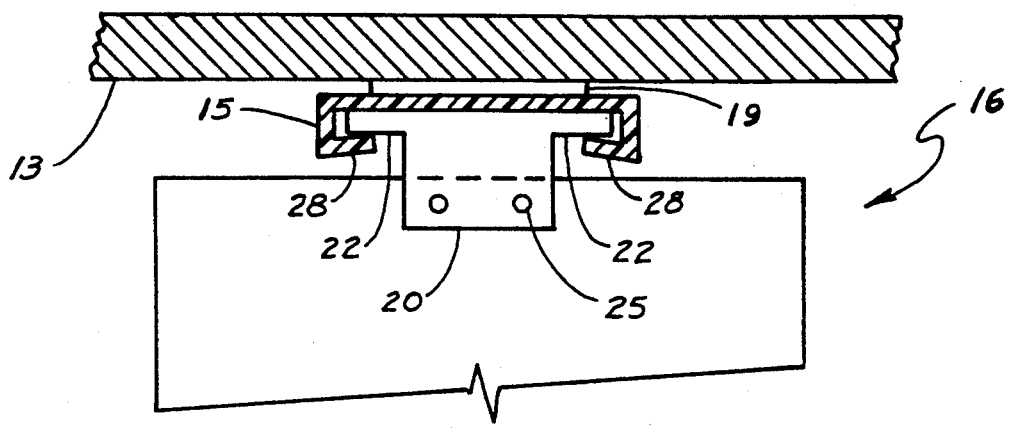
FIG. 3 is a sectional view taken in the direction of line 3—3 of FIG. 2.

The book end device 10 comprises a linear slotted track 15 and a book end 16 which can slide in track 15 (FIG. 2,3). The slotted track 15 is made of a resilient semi-flexible plastic material having a C-shape cross-section with turned-in lips 28 as shown in FIG. 3. Sufficient clearance 17 is provided between each end of track 15 and the bookcase sides 18 to allow for the insertion of book end 16 into track 15 from either end (FIG. 1). The track 15 is fastened to the bookcase surface 13 with pieces of 1/16 inch thick foam type double-sided adhesive tape 19 spaced at intervals along the length of track 15 (FIGS. 2,3).

Tape 19 also functions as a resilient spacer between surface 13 and track 15 to allow clearance for track 15 to flex and to deform as explained later. Still another function of tape 19 is to enable installing book end device 10 without the use of tool and hardware.

Figure 4:
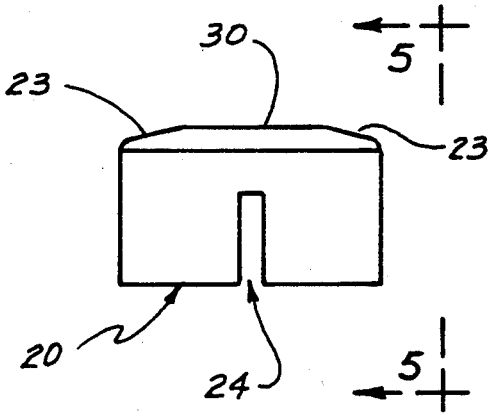
FIG. 4 is an elevation view of the slide piece.
Figure 5:
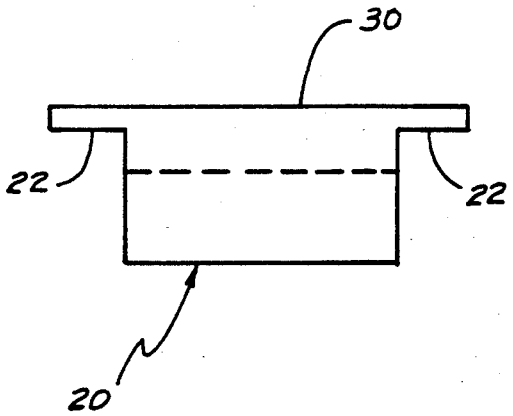
FIG. 5 is a elevation view taken in the direction of line 5—5 of FIG. 4.
Figure 6:
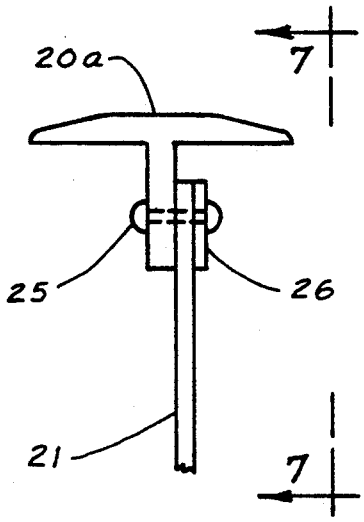
FIG. 6 is an elevation view of the slide piece showing an alternate construction.
Figure 7:
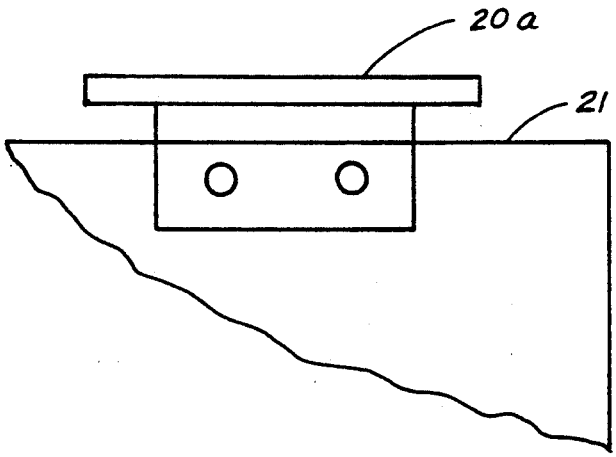
FIG. 7 is an elevation view taken in the direction of line 7—7 of FIG. 6.

Although it may be desirable to manufacture book end 16 as one integral piece of molded plastic (not illustrated) for simplicity of construction and for commercial reasons, it is herein described as being to be fabricated in two sections, a slide piece 20 for insertion into track 15, and a flat panel 21 as shown in FIGS. 2,3. The slide piece 20 is T-shaped with the flanges 22 being of such thickness so as to provide a snug and frictional fit in track 15 (FIG 3). The top of slide piece 20 has beveled and sloped leading and trailing edges 23 (FIGS. 2,4), the words leading and trailing and trailing relating to the direction of sliding movement; these edges resulting in top 30 having a somewhat convex curved shape symmetrical about the vertical central line of slide piece 20 as viewed in a vertical plane parallel to track 15. The width across flanges 22 of top 30 is slightly less than the width of slot 29 in track 15 (FIG. 3). The bottom of slide piece 20 has a groove 24 for receiving flat panel 21 (FIGS. 2,4). It is contemplated that slide piece 20 be made of a molded plastic material. Flat panel 21 is a relatively thin and stiff material which is securely attached to groove 24 of side piece 20 with cement or with mechanical fasteners 25 (FIGS. 2,3). An alternate form of construction of slide piece 20 is to fabricate it from an aluminum T-section 20*a* (FIGS. 6,7), and attaching flat panel 21 with mechanical fasteners 25 and a washer plate 26. While flat panel 21 can be made in various sizes and of various types of materials, such as plastic, hardboard or sheet metal, it is contemplated to be made of plastic sheet approximately 6 inches high, 4½ inches wide, and 1/16 inch thick. The length of the flat panel 21 is such that it engages only the upper part of an upright book 12. This allows the book 12 to slide off of panel 12 without damaging book end 16 in the event the book end 16 is left positioned too far away to prevent book 12 from falling.

Figure 8:
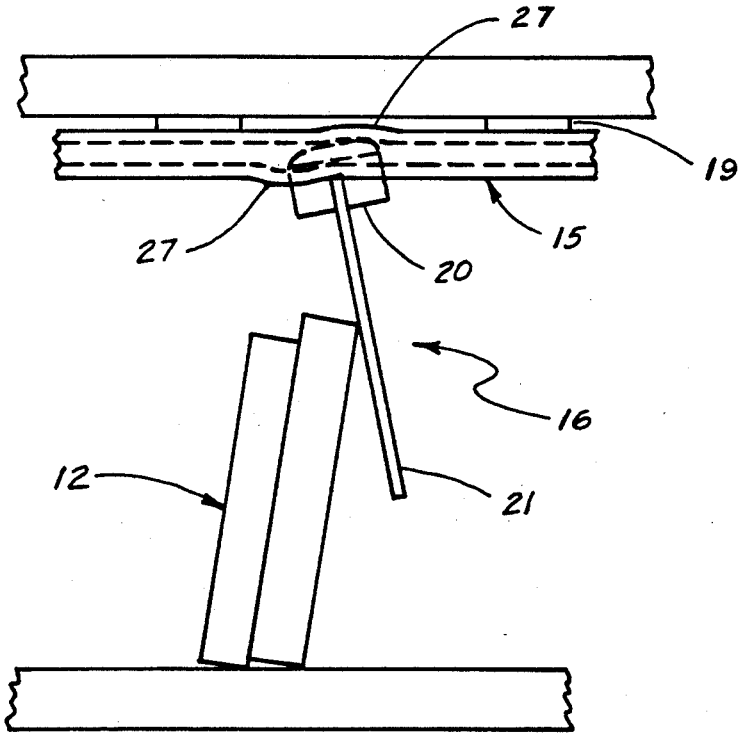
FIG. 8 is an elevation view of the book end device showing the book end in a tilting position due to lateral force being exerted by leaning books.

The significance of the various construction details described above is explained by referring to FIG. 8. The book end device 10 is constructed such that book end 16 can readily be adjusted to any position along track 15 while book end 16 is held in a vertical position. However, it must also be such that it will not inadvertently shift or slip in the track due to the lateral force from books which may lean against it form either side. This is accomplished by the frictional fit between slide piece 20 and track 15 to take advantage of frictional force, and also by the curved top 30 of slide piece 20 which allows book end 16 to tilt or rock in either direction, causing track 15 to twist and flex at two points 27, and to deform and become non-linear, resulting in the wedging and locking of slide piece 20 within track 15. Since this action can occur due to lateral forces from either direction, the book end device 10 can be described as being bidirectional.

Thus, frictional fit is the first line of defense against shifting of book end 16 due to small lateral forces exerted by slightly leaning books 12, or due to tall leaning books 12 engaging end 16 at a higher level on book end 16. When tilting occurs due to greater forces exerted by books 12 which lean at a greater angle, or when books 12 engage book end 16 at a lower level, book end 16 locks in place and will not shift. When lateral forces are removed from book end 16, track 15 returns to its linear orientation and forces book end 16 to return to an unlocked vertical position.

Book end device 10 is for use with an ordinary bookcase made from wood, metal, or other materials from which book-cases are made, and which does not require recesses or built-in slots. The vertical space occupied track 15 and slide piece 20 is approximately 0.375" to 1.0" depending upon the construction of slide piece 20. The clearance between track 15 and stored books 12 can be as little as a fraction of an inch.

This invention is believed to be adequately described herein regarding the preferred embodiment described above and shown on the drawings. It is not intended that this invention be limited to the particular details illustrated, as it is expected that others skilled in the art may devise various alternatives, modifications or equivalents as may be included within the spirit and scope of the invention, which is defined by the claims.

I claim:

1. For use with an ordinary bookcase, a hanging book end device for supporting books stored in an upright position on a shelf which is immediately below said device, said device comprising:

(a) a single linear slotted track made of a resilient material having a C-shaped cross-section which defines an open slot with two opposing turned-in coplanar lips, said track adapted for mounting on and parallel to a horizontal flat surface above said books with said slot facing downward, said track being mounted with several pieces of foam type double-sided adhesive tape which also function as resilient spacers between said flat surface and said track, said pieces of tape being spaced at equal intervals along the length of said track; and (b) a book end removably and slidably engaged in said track and pending from and transverse to said track, said book end comprising of a thin and relatively stiff flat panel to engage and support said books, and a slide piece to slidably engage said panel to said track, said slide piece having:

(1) a T-shaped cross-section as viewed in a vertical plane transverse to said track, with the top cross-member of said slide piece forming two coplanar flanges which fit into said slot of said track; (2) a width across said flanges slightly less than the width of said slot;

(3) a thickness of said flanges slightly greater than the vertical clearance within said slot to provide a frictional fit to resist shifting of said book end when a lateral force is exerted by said books leaning from either side; and (4) a top with beveled and sloped edges forming a somewhat convex curved shape symmetrical about the vertical center line of said slide piece as viewed in a vertical plane parallel to said track, whereby said slide piece will coact with said track when the lateral force exerted on said book end by said books leaning from either side is sufficient to tilt or rock said book end and cause twisting and deformation of said track, making said track non-linear, thereby resulting in the wedging and locking of said book end within said track.

* * * * *